US007714785B2

(12) United States Patent
Hsu et al.

(10) Patent No.: US 7,714,785 B2
(45) Date of Patent: May 11, 2010

(54) GPS ANTENNA MODULE AND MANUFACTURING METHOD THEREOF

(75) Inventors: Kang-Neng Hsu, Hsinchu (TW); Yueh-Lin Tsai, Hsinchu (TW); Chih-Hsin Chiu, Hsinchu (TW); Jyun-Ren Wang, Hsinchu (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 327 days.

(21) Appl. No.: 11/826,052

(22) Filed: Jul. 12, 2007

(65) Prior Publication Data

US 2009/0015482 A1 Jan. 15, 2009

(51) Int. Cl.
*H01Q 1/38* (2006.01)

(52) U.S. Cl. ..... 343/700 MS; 343/841

(58) Field of Classification Search ..... 343/700 MS, 343/829, 846, 841
See application file for complete search history.

(56) References Cited

U.S. PATENT DOCUMENTS 6,040,806 A * 3/2000 Kushihi et al. ..... 343/853
6,924,688 B1 * 8/2005 Beigel ..... 327/330
2003/0020657 A1 * 1/2003 Sakamoto et al. ..... 343/700 MS
2003/0197651 A1 * 10/2003 Yuanzhu ..... 343/725
2004/0212536 A1 * 10/2004 Mori et al. ..... 343/700 MS
2005/0099338 A1 * 5/2005 Noro et al. ..... 343/700 MS
2006/0049987 A1 * 3/2006 Herrick ..... 343/700 MS

* cited by examiner

*Primary Examiner*—Tho G Phan
(74) *Attorney, Agent, or Firm*—Rosenberg, Klein & Lee

(57) ABSTRACT

A GPS (Global Positioning System) antenna module includes a substrate, a first insulating layer, and a second insulating layer. The substrate is set on a bottom surface of a patch antenna. The first insulating layer is coated on the substrate and a layout circuit is formed thereon. A plurality of electronic elements are integrated on the substrate according to the layout circuit. Furthermore, the second insulating layer is coated on the first insulating layer to completely shield the electronic elements integrated on the substrate. Hence, the distance between the electronic elements and the antenna of the present invention can be shortened, space on the PCB and in the shielding case is saved. Moreover, an optimal high frequency character can be achieved, the volume of the antenna module is effectively reduced, the process is simplified, and production costs are reduced.

16 Claims, 4 Drawing Sheets

GPS ANTENNA MODULE AND MANUFACTURING METHOD THEREOF

BACKGROUND OF THE INVENTION

1. Field of the Inventiong

The present invention relates to an antenna module and a manufacturing method thereof, and more specifically to an antenna module used in a GPS and a manufacturing method thereof.

2. Description of the Prior Art

Recently, GPS (Global Positioning System) has become more widely used, especially for navigation positioning. By integrating secondary satellites and communication techniques, accurate positioning, direction and distance can be easily found by anybody; even their speed and time can be known. Hence, the application scope of GPS is very wide. Many kinds of mobile communication devices (such as mobile phones, PDAs, etc.), or relative car electronic devices have been integrated with GPS functions, and GPS has thereby become a necessary function for many devices.

However, because of the rapid development of techniques, demands on utility and the need for portability, the size of electronic elements has tended towards becoming smaller and smaller. When integrating multiple functions into a single product, the space occupied by elements must be taken into account. The volume of chips or semiconductor elements can be reduced easily because of the development of packaging processes. However, the volume of prior art GPS antenna modules is difficult to reduce. Please refer to FIG. 1, in which a cutaway view of an antenna module frame of a prior art is shown. The antenna module includes a three layered frame that includes a patch antenna 100*a*, a PCB (printed circuit board) 300*a*, and a shielding case 400*a*. One surface of the PCB 300*a* is soldered with a plurality of electronic elements 310*a*, and another surface is adhered with the patch antenna 100*a* via double-sided glue 200*a*. The patch antenna 100*a* is connected electronically with the soldered dots 500*a* via the antenna pin 101*a* which penetrates the PCB 300*a*. Moreover, the shielding case 400*a* is soldered on the side of the PCB 300*a* soldered with a plurality of electronic elements 310*a* via the soldering dots 501*a*. Because of the volume of the PCB 300*a* and the shielding case 400*a*, the volume of the antenna module is limited and cannot to be further reduced. Hence, it is difficult to satisfy the finesse and demands of small products and devices. Further more, for the processes of the antenna module, there are many soldering dots 500*a*, 501*a* that must be soldered on manually, thus, the efficiency of the processes and costs are affected.

If the volume of the antenna module is reduced, costs are lowered, and a steady efficiency and characteristic are maintained, thereby, the antenna module becomes more cost competitive. Hence, the GPS antenna module and the processes thereof can be improved further.

Hence, the inventors of the present invention believe that the shortcomings described above are able to be improved upon and suggest the present invention which is of a reasonable design and is an effective improvement based on deep research and thought.

SUMMARY OF THE INVENTION

An object of the present invention is to provide an antenna module and a manufacturing method thereof. The volumes of the PCB and the shielding case are omitted, and the PCB and the shielding case are substituted by two insulating layers which are coated on a patch antenna. The processes are similar to the semiconductor process. Hence, the volume of the antenna module is reduced, and an optimal high frequency characteristic is achieved.

To achieve the above-mentioned object, a GPS antenna module is disclosed. The module comprises a substrate, a first insulating layer, and a second insulating layer. The substrate is set on a bottom surface of a patch antenna. The first insulating layer is coated on the substrate, and a layout circuit is formed on the first insulating layer. A plurality of electronic elements is integrated on the substrate according to the layout circuit. The second insulating layer is coated on the first insulating layer to shield the electronic elements.

To achieve the above-mentioned object, a manufacturing method of the GPS antenna module is disclosed. The method comprises providing a patch antenna; coating a first insulating layer on the bottom surface of the patch antenna; forming a layout circuit on the first insulating layer; integrating a plurality of electronic elements on the substrate according to the layout circuit; and coating a second insulating layer on the first insulating layer to shield the electronic elements.

To further understand the features and technical contents of the present invention, please refer to the following detailed description and drawings related to the present invention. However, the drawings are only to be used as references and explanations, and not to limit the present invention.

DETAILED DESCRIPTION OF THE INVENTION

Figure 1:
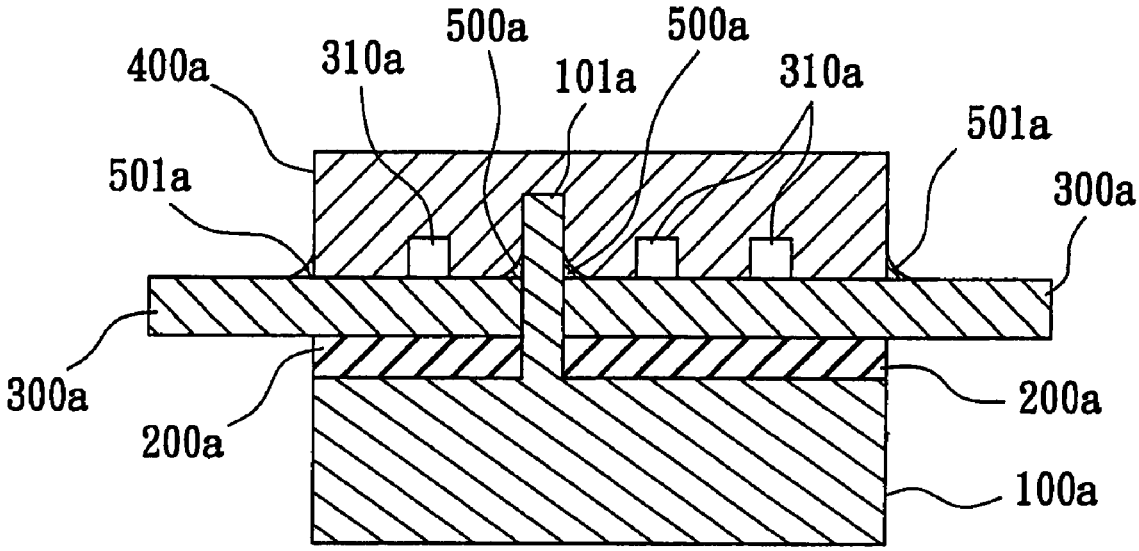
FIG. 1 PRIOR ART
FIG. 1 is a cutaway view of an antenna module of a prior art.
Figure 2A:
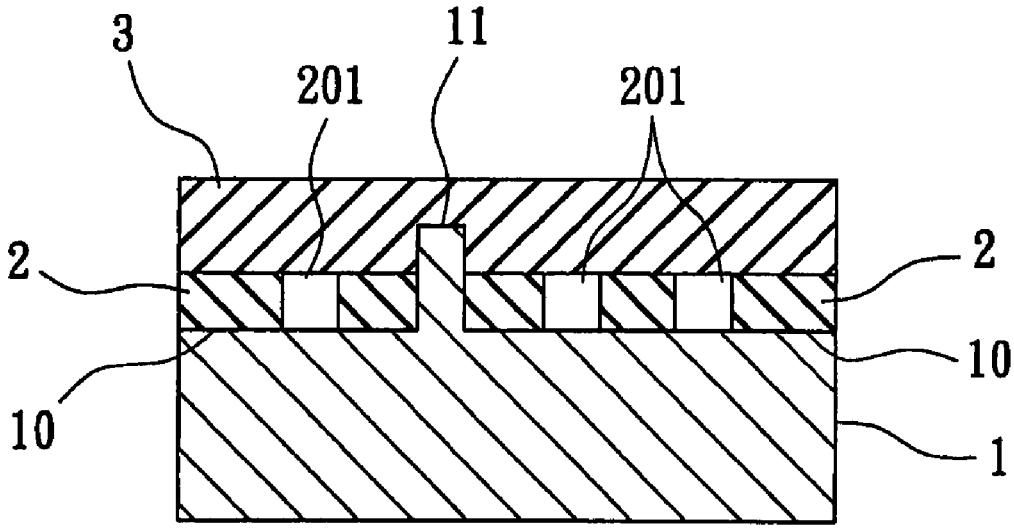
FIG. 2A is a cutaway view of an antenna module of the present invention.

Please refer to FIG. 2A, in which a cutaway view of an antenna module of the present invention is shown. The antenna module used in a GPS (Global Positioning System) includes a patch antenna 1, a first insulating layer 2, and a second insulating layer 3. Please also refer to FIG. 2B, in which an exploded view of an antenna module of the present invention is shown. A substrate 10 is set on the bottom surface of the patch antenna 1 and is made of ceramic. The first insulating layer 2 is coated on the substrate 10, and a layout circuit 20 is formed thereon by semiconductor processes such as using photo resist, developing and etching, etc. The layout circuit 20 can be an antenna amplifier circuit for the GPS receiving signals, or can be a decoding circuit needed by a relative decoding chip. The patch antenna 1 includes an antenna pin 11, which connects electronically with the layout circuit 20 to transmit the GPS signals. A plurality of electronic elements 201 are integrated on the substrate 10 according to the layout of the layout circuit 20 and the element positions, and are connected with the antenna pin 11 via the layout circuit 20. The electronic elements 201 are integrated on the substrate 10 via LTCC (Low-Temperature Co-fired Ceramics), printed processes, or heat-transferring processes, etc. The electronic elements 201 are integrated as bare chips, and the packaging method is not required. Hence, the high frequency characteristic is optimized, and the cost of the elements is lowered further.

The second insulating layer 3 is coated on the first insulating layer 2 to shield the electronic elements 201, and thereby prevent the electronic elements 201 from being damaged and signal from suffering interference. The first insulating layer 2 and the second insulating layer 3 can be coated by spin coating, roller coating, ink jet printing, slot die coating, screen printing, or imprinting methods, etc. The material of the first insulating layer 2 and the second insulating layer 3 can be silicon dioxide, plasma nitride, plastic, or glass, etc.

Figure 2B:
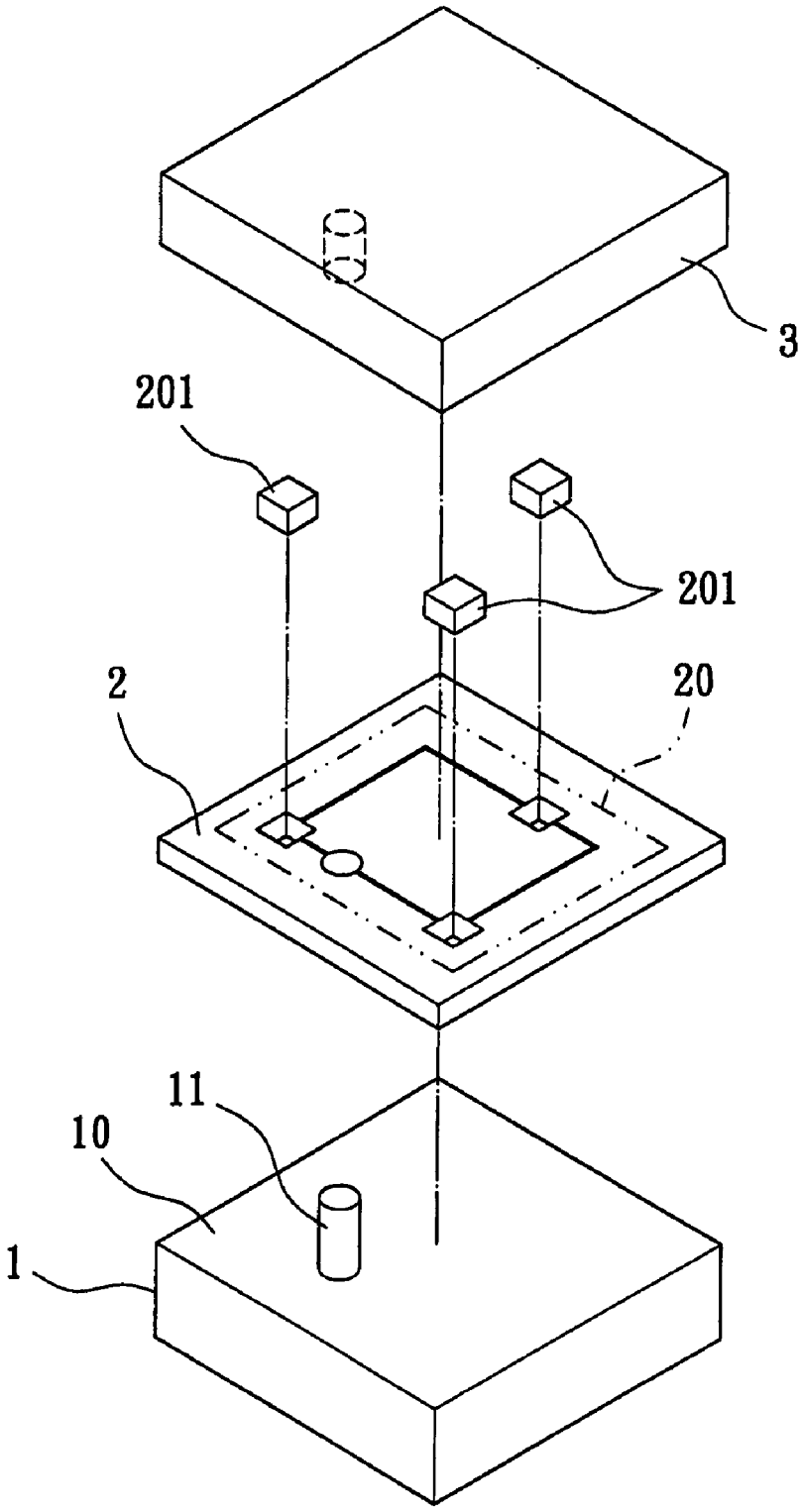
FIG. 2B is an exploded view of an antenna module of the present invention.
Figure 3:
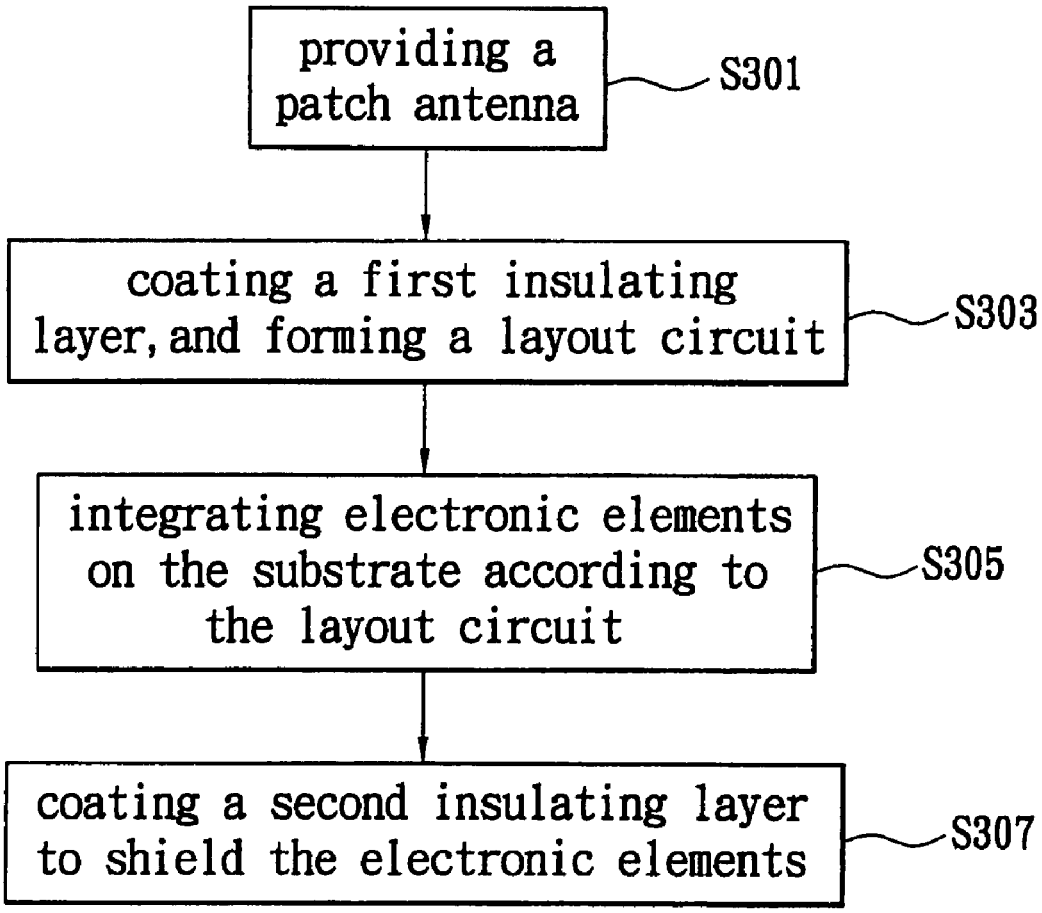
FIG. 3 is a flow chart of a manufacturing method of the antenna module of the present invention.

Please refer to FIG. 3, in which a flow chart of a manufacturing method of an antenna module of the present invention is shown, and also to FIG. 2B. Firstly, to provide the patch antenna 1 (S301) the substrate 10 is set on the bottom surface of the patch antenna 1 and is made of ceramic. The antenna pin 11 is set on a bottom surface of the patch antenna 1. Then, the first insulating layer 2 is coated on the substrate 10 of the patch antenna 1, and the layout circuit 20 is formed on the first insulating layer 2 via semiconductor processes (such as using photo resist, developing and etching, etc.) (S303).

The electronic elements 201 are integrated on the substrate 10 of the patch antenna 1 according to the relative element positions on the layout circuit 20 (S305). The integrating method can be LTCC (Low-Temperature Co-fired Ceramics), printed processes, or heat transferring processes, etc. The antenna pin 11 is connected electronically with the electronic elements 201 by forming the layout circuit 20 and integrating the electronic elements 201. The GPS signal received by the antenna module can be filtered and amplified therein.

Finally, the second insulating layer 3 is coated on the first insulating layer 2, thereby completely shielding the electronic elements 201, which are integrated on the substrate 10 and exposed on the first insulating layer 2 (S307). Hence, signal interference and damage to the electronic elements 201 can be avoided.

In summary, the volume taken up by the PCB and the shielding case of the prior art can be omitted, and thereby the size of the antenna module can be reduced and the cost lowered. Because the distance between the electronic elements 201 and the antenna is shortened, an optimal high frequency character can be achieved. Moreover, the process for manufacturing the antenna module of the present invention is simplified by the SMT method (surface mounted technology), which shortens production time and assembly time. Careless mistakes made by manual soldering can be indirectly reduced, which increases the yield of the products.

What is disclosed above are only the preferred embodiments of the present invention, and therefore it is intended that the present invention not be limited to the particular embodiments disclosed. It should be understood by those skilled in the art that various equivalent changes may be made depending on the specifications and the drawings of present invention without departing from the scope of the present invention.

What is claimed is:

1. A GPS antenna module, comprising:

a patch antenna;

a substrate disposed on a bottom surface of said patch antenna, wherein said substrate has a contact surface area equivalent to and matching said bottom surface of said patch antenna;

a first insulating layer, coated on the substrate, a layout circuit being formed on the first insulating layer, a plurality of electronic elements being integrated on the substrate according to the layout circuit; wherein said layout circuit is disposed over an area less than a surface area of said first insulating layer; and a second insulating layer, coated on the first insulating layer to seal and shield the electronic elements; wherein both said first and second insulating layers have contact surface areas equal to or less than said contact surface area of said substrate, and wherein both first and second insulating layers are coated via a semiconductor process.

2. The GPS antenna module as claimed in claim 1, wherein the substrate is made of ceramic.

3. The GPS antenna module as claimed in claim 1, wherein the patch antenna further comprises an antenna pin, which connects electronically with the layout circuit to transmit GPS signals.

4. The GPS antenna module as claimed in claim 1, wherein the layout circuit is formed on the first insulating layer via semiconductor processes such as coating photo resist, exposure, developing and etching.

5. The GPS antenna module as claimed in claim 1, wherein the layout circuit comprises at least an antenna amplifier circuit, or comprises the antenna amplifier circuit and a decoding chip.

6. The GPS antenna module as claimed in claim 1, wherein the electronic elements are integrated on the substrate via LTCC, printed process, or heat transferring process.

7. The GPS antenna module as claimed in claim 1, wherein the electronic elements are integrated as bare chips.

8. The GPS antenna module as claimed in claim 1, wherein the first insulating layer and the second insulating layer can be coated by spin coating, roller coating, ink jet printing, slot die coating, screen printing, or imprinting.

9. The GPS antenna module as claimed in claim 1, wherein the material of the first insulating layer and the second insulating layer can be silicon dioxide, plasma nitride, plastic, or glass.

10. A manufacturing method of the GPS antenna module, comprising:

providing a patch antenna, and utilizing a bottom surface of said patch antenna to be a substrate, a contact surface area of which is equivalent to and matches said bottom surface of said patch antenna;

coating a first insulating layer on the substrate, and forming a layout circuit on the first insulating layer; wherein said layout circuit is disposed over an area less than a surface area of said first insulating layer;

integrating a plurality of electronic elements on the substrate according to the layout circuit; and coating a second insulating layer on the first insulating layer to seal and shield the electronic elements; wherein said first and second insulating layers are coated via a semiconductor process; and wherein both said first and second insulating layers have contact surface areas equal to or less than said contact surface area of said substrate.

11. The manufacturing method of the GPS antenna module as claimed in claim 10, wherein the substrate is made of ceramic.

12. The manufacturing method of the GPS antenna module as claimed in claim 10, wherein the layout circuit is formed on the first insulating layer by a semiconductor process such as using photo resist, exposure, developing and etching.

13. The manufacturing method of the GPS antenna module as claimed in claim 10, wherein the layout circuit comprises an antenna amplifier circuit at least, or comprises the antenna amplifier circuit and a decoding circuit.

14. The manufacturing method of the GPS antenna module as claimed in claim 10, wherein the electronic elements are integrated on the substrate via LTCC, printed process, or heat transferring process.

15. The manufacturing method of the GPS antenna module as claimed in claim 10, wherein the first insulating layer and the second insulating layer can be coated via spin coating, roller coating, ink jet printing, slot die coating, screen printing, or imprinting.

16. The manufacturing method of the GPS antenna module as claimed in claim 10, wherein the material of the first insulating layer and the second insulating layer can be silicon dioxide, plasma nitride, plastic, or glass.

* * * * *